United States Patent [19]

Sober

[11] Patent Number: 4,674,987

[45] Date of Patent: Jun. 23, 1987

[54] TOY FOR AMUSEMENT AND/OR EXERCISE

[75] Inventor: Norman Sober, Baltimore, Md.

[73] Assignee: Leonard Bloom, Owings Mills, Md. ; a part interest

[21] Appl. No.: 822,109

[22] Filed: Jan. 24, 1986

[51] Int. Cl.[4] ..... A63H 33/00

[52] U.S. Cl. ..... 446/170; 272/128

[58] Field of Search ..... 446/170, 168, 171, 453, 446/451, 450, 266; 273/109, 322; 272/128; D21/92

[56] References Cited

U.S. PATENT DOCUMENTS

| | | | |
|---|---|---|---|
| 418,166 | 12/1889 | Collin | 273/109 |
| 1,815,378 | 7/1931 | Menkus et al. | 446/168 X |
| 3,216,725 | 11/1965 | Hing | 446/27 X |
| 3,222,818 | 12/1965 | Grubbs | 446/450 |

FOREIGN PATENT DOCUMENTS

| | | | |
|---|---|---|---|
| 499626 | 5/1953 | Canada | 446/170 |

*Primary Examiner*—Mickey Yu

*Attorney, Agent, or Firm*—Leonard Bloom

[57] ABSTRACT

A whirling toy for amusement and/or exercise has a plurality of small hoops in substantially side-by-side spaced relationship in the same plane, and balls are received in respective trackways formed in the hoops. In a preferred embodiment, the hoops are mounted within a large outer hoop. When the outer hoop is manually oscillated, the balls rotate around their respective trackways and are retained therein by reason of centrifugal force. A plurality of circumferentially-spaced apertures are formed in at least one of the smaller hoops, thereby providing an audible sound as the ball whirls around its respective trackway. Alternate embodiments of the invention are also illustrated.

1 Claim, 12 Drawing Figures

TOY FOR AMUSEMENT AND/OR EXERCISE

FIELD OF THE INVENTION

The present invention relates to a toy, and more particularly, to a hoop type of toy for amusement and/or exercise.

BACKGROUND OF THE INVENTION

In the prior art, toys having a ball that whirls around a circular trackway in a hoop, wherein the ball is retained in the trackway by means of centrifugal force as the hoop is manually oscillated, are well known.

Examples are disclosed in the following prior U.S. Patents:

| Inventors(s) | U.S. Pat. No. | Year of Issue |
|---|---|---|
| Pace | 591,876 | 1897 |
| Jack | 625,680 | 1899 |
| Borek | 2,198,075 | 1937 |
| Marong | 2,466,116 | 1949 |
| Serethy | 3,060,627 | 1962 |
| Carper | 3,202,426 | 1965 |
| Wiggen | 3,638,350 | 1972 |
| Taylor et al. | 4,429,487 | 1984. |

These prior art disclosures, while interesting, have certain inherent disadvantages or deficiencies and do not appear to have met with substantial commercial success of long standing, nor are those devices currently available on the market.

SUMMARY OF THE PRESENT INVENTION

Accordingly, it is an object of the present invention to alleviate the disadvantages and deficiencies of the prior art by providing a unique whirling toy that is attractive and interesting, and that may be easily manipulated by young and old alike for amusement and/or exercise.

It is another object of the present invention to provide a whirling toy that may be produced economically for widespread distribution through normal consumer merchandising and distribution channels.

In accordance with the teachings of the present invention, there is herein illustrated and described, a whirling toy wherein a plurality of hoops are secured in spaced relationship to each other in substantially the same plane. A trackway is formed in each of the hoops, and the trackways are independent of each other. A ball is received in each of the trackways; and means are provided for manually grasping and oscillating the hoops, so that the balls rotate around their respective trackways in the spaced hoops by reason of centrifugal force.

In a preferred embodiment, two relatively small hoops are employed substantially side-by-side; the small hoops are preferably of substantially the same size and are mounted within a large outer hoop. Each of the small hoops has a substantially U-shaped respective trackway. At least one of the hoops is provided with a plurality of circumferentially-spaced apertures communicating with its respective trackway, so that an audible sound will be produced as the respective ball rotates therein.

If desired, each ball may be tethered by a rubber band or string. This arrangement facilitates retrieval of the ball if it falls out of its trackway.

In an alternate or second embodiment, the smaller hoops are of substantially different size.

In a third embodiment, three smaller hoops are mounted within a larger outer hoop; the smaller hoops are circumferentially spaced along respective radii which are substantially equiangular from one another, and the smaller hoops are in contact with each other and with the larger outer hoop. All of the hoops are in substantially the same plane, and the three smaller hoops have balls rotating around respective trackways.

In a fourth embodiment, two hoops are mounted substantially side-by-side and are connected at their respective outermost portions by a semi-annular hoop.

In a fifth embodiment, two hoops are provided and are connected together by a single strut which may be grasped by the user.

These and other objects of the present invention will become readily apparent from a reading of the following specification taken in accordance with the enclosed drawings.

GENERAL DESCRIPTION OF THE PREFERRED EMBODIMENTS

Figure 1:
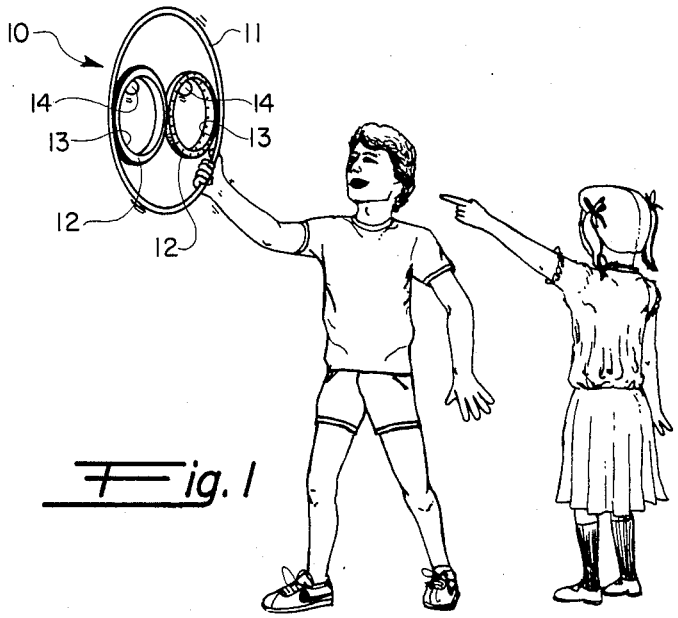
FIG. 1 illustrates how the toy of the present invention may be manipulated for fun, enjoyment and healthful exercise.
Figure 2:
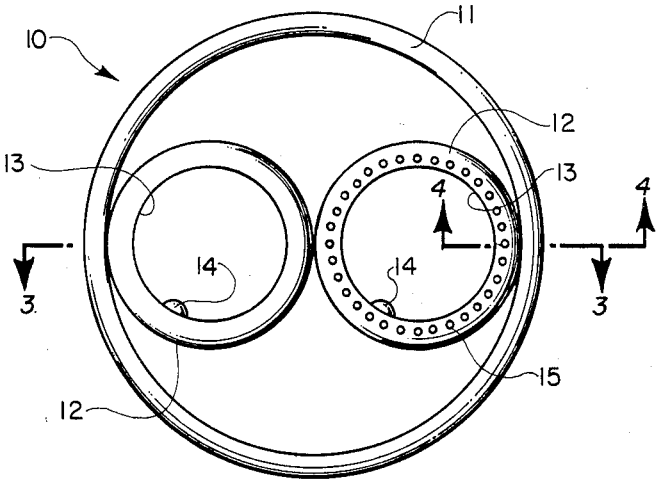
FIG. 2 is a plan view of a first (and preferred) embodiment of the whirling toy of the present invention, showing the pair of smaller hoops mounted with a large outer hoop.
Figure 3:
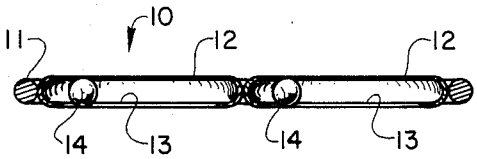
FIG. 3 is a cross-sectional view thereof, taken across the lines 3—3 of FIG. 2, showing respective balls in the smaller hoops, and further showing all of the hoops in substantially the same plane.
Figure 4:
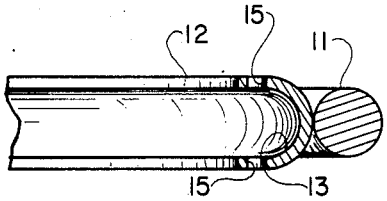
FIG. 4 is a further cross-sectional view thereof, taken across the lines 4—4 of FIG. 2 and enlarged in scale, and showing the substantially U-shaped trackway formed in each of the smaller hoops.

With reference to FIGS. 1–4, the preferred toy 10 has an outer large ring or hoop 11 within which a pair of smaller hoops 12 are mounted. The smaller hoops 12 are mounted side-by-side and are in contact with each other and with the outer hoop, and all of the hoops are in substantially the same plane. A substantially U-shaped trackway 13 is formed in each of the smaller hoops, as shown more clearly in FIG. 4, and a ball 14 is received in each of the trackways.

In operation, the toy 10 may be grasped at any point along the periphery of the large outer hoop 11, as shown more clearly in FIG. 1. As the toy is oscillated slightly through an angle, the balls 14 will be rotated around their respective trackways 13 in the smaller hoops 12 by reason of centrifugal force. The toy 10 may be held in a substantially vertical plane until the balls 14 are rotating around the trackways, and then if desired, the toy may be held in an angled or even a horizontal plane as the user's skill improves with practice and experience.

Each of the hoops 11 and 12 may be made of a suitable molded plastic material and may be made in a variety of attractive colors. The hoops 12 may be secured to each other and to the larger outer hoop 11 by an adhesive or other suitable means.

With reference again to FIGS. 2 and 4, at least one of the smaller hoops may be formed with a plurality of circumferentially-spaced apertures 15 around the periphery thereof, the apertures 15 communicating with the respective trackway therein. As the ball 14 rotates around its trackway, an audible sound is produced. The sound may consist of a whistle, or possibly a musical tone, for maximum enjoyment of the toy.

Figure 5:
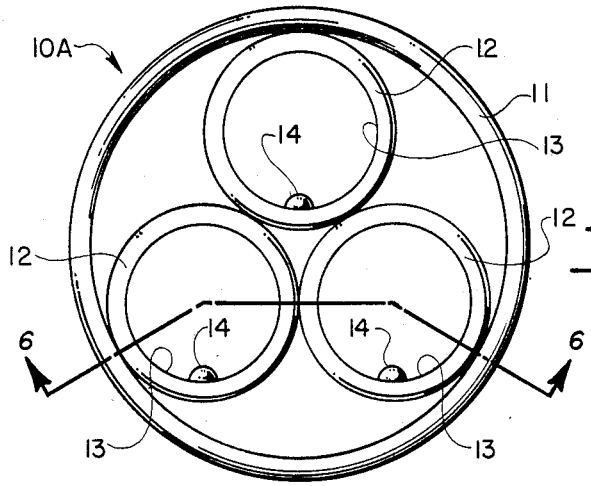
FIG. 5 is a plan view of a first alternate embodiment in which three smaller hoops are arranged substantially equiangularly within a large outer hoop.
Figure 6:
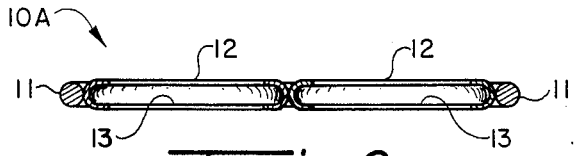
FIG. 6 is a cross-sectional view thereof, taken across the lines 6—6 of FIG. 5.

With reference to FIGS. 5 and 6, which illustrate a second embodiment of the present invention, the toy 10A has three small hoops 12 mounted within the larger outer hoop 11. The hoops 12 are arranged on respective radii which are circumferentially spaced substantially equiangularly from one another.

Figure 7:
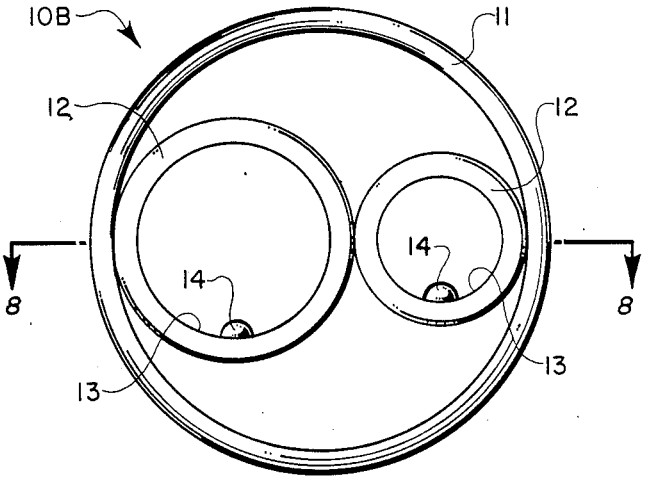
FIG. 7 is a plan view of a second alternate embodiment, wherein the smaller hoops within the large outer hoop are of substantially different size.
Figure 8:
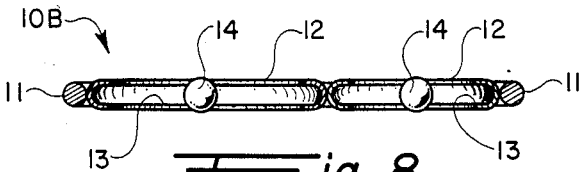
FIG. 8 is a cross-sectional view thereof, taken across the lines 8—8 of FIG. 7.

With reference to FIGS. 7 and 8, which illustrate a third embodiment, the toy 10B has its smaller hoops 12 of a substantially different size.

Figure 9:
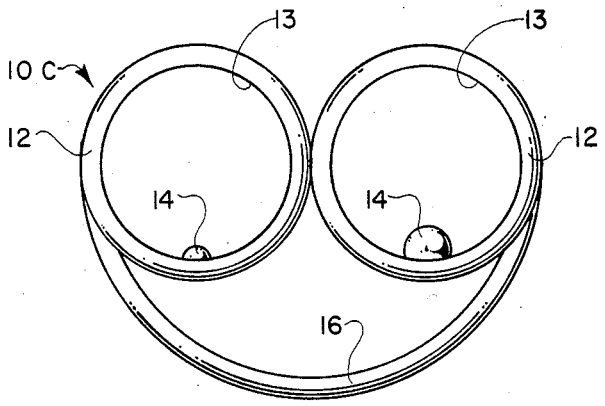
FIG. 9 is a plan view of a third alternate embodiment, wherein a semi-annular ring is secured to the respective extremities of the smaller hoops, and wherein the respective balls are of different size.
Figure 10:
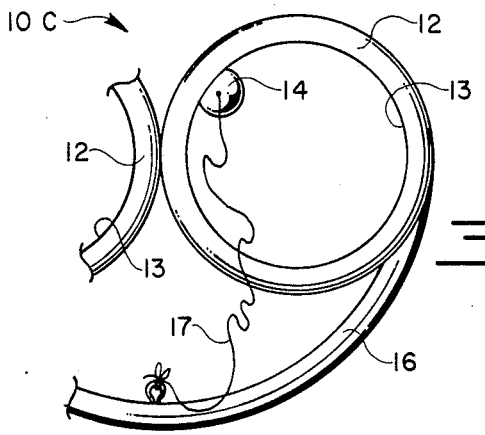
FIG. 10 is a portion of FIG. 9, wherein the ball is tethered by a string.

With reference to FIGS. 9 and 10, which illustrate a fourth embodiment, the toy 10C has its smaller hoops 12 connected at their outermost extremities by a semi-annular ring 16 which may be grasped by the user. The balls 14 may also be of different size; and as shown in FIG. 10, the ball 14 may be tethered by a suitable string or rubber band 17. Thus, if the ball falls out of its trackway, its retrieval is conveniently facilitated.

Figure 11:
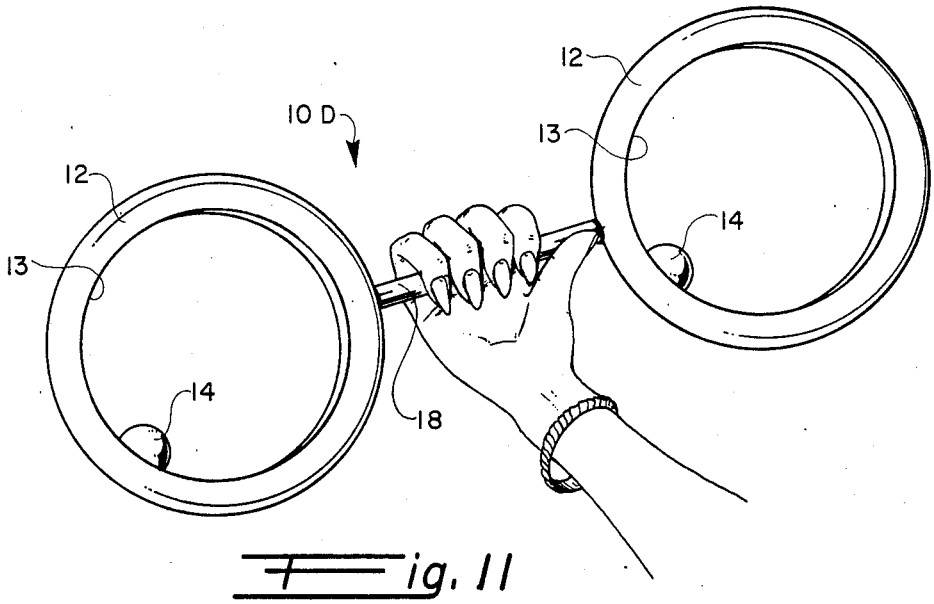
FIG. 11 is an isometric view of a fourth alternate embodiment, wherein the toy may be manipulated by gripping a single strut connecting a pair of spaced hoops.

With reference to FIG. 11, which illustrate a fifth embodiment, the toy 10D has its smaller hoops 12 connected by a strut 18. The strut may be suitably grasped by the user to oscillate the toy and cause the balls to rotate around their respective trackways.

Each of the embodiments of the present invention may be used in substantially the same manner to produce substantially the same results.

Figure 12:
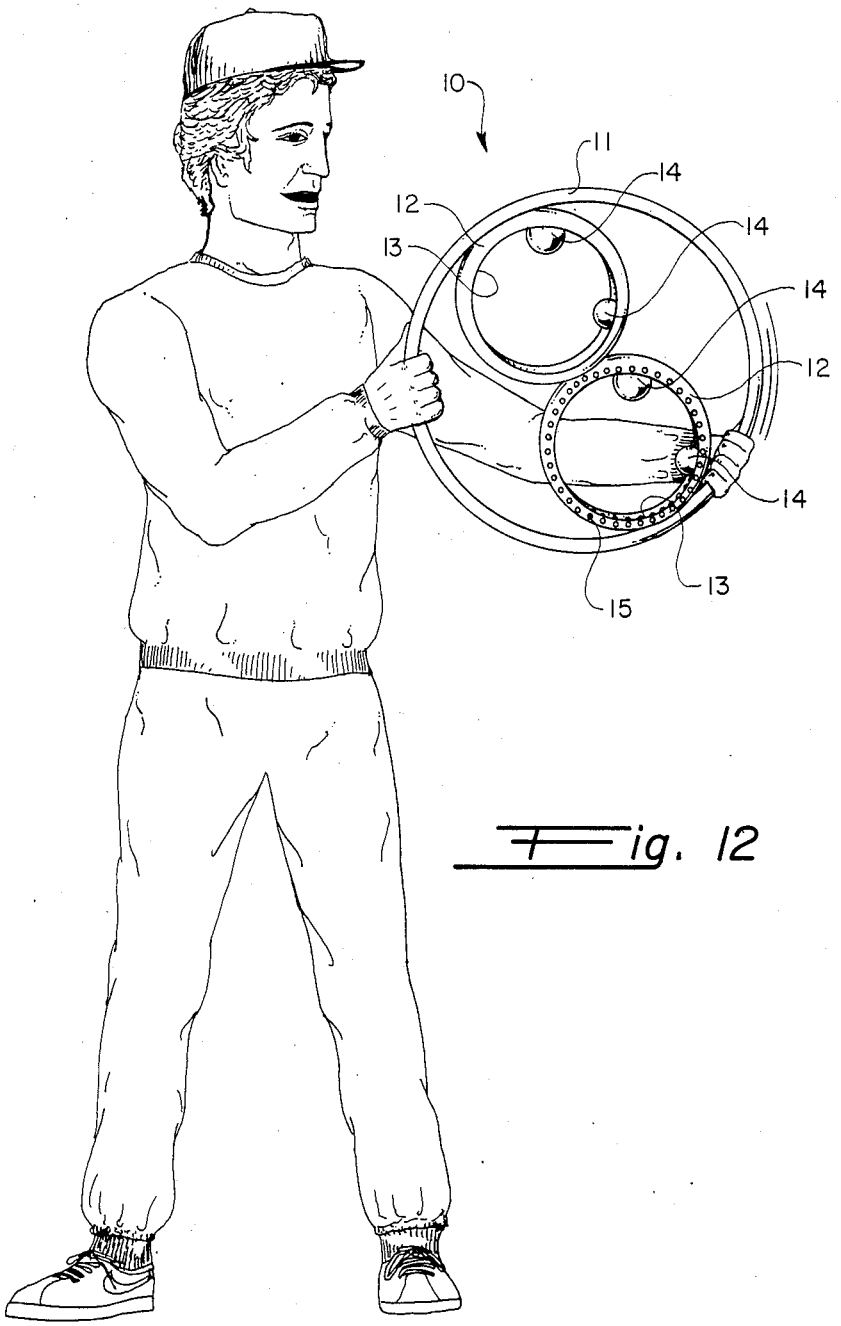
FIG. 12 illustrates how the large hoop may be grasped by both hands and oscillated for maximum desired exercise.

With reference to FIG. 12, the hoop 10 may be grasped by both hands (if desired) and held in front of the user for maximum beneficial exercise. The hoop may be held in a vertical or horizontal position, as before.

Obviously, many modifications may be made without departing from the basic spirit of the present invention. For example, more than one ball could be in each trackway in a respective hoop, and if desired, the balls could be of different size. Accordingly, it will be appreciated by those skilled in the art that within the scope of the appended claims, the invention may be practiced other than has been specifically described herein.

I claim:

1. A toy, comprising a large circular outer hoop, having a substantially round cross-section, a pair of smaller inner circular hoops of substantially identical size mounted in side-by-side relationship within the large outer hoop, the smaller inner hoops being disposed along a diametrical axis of the large outer hoop, and the smaller inner hoops joining each other directly at the approximate center of the large outer hoop, all of the hoops being in substantially the same plane, a substantially U-shaped trackway formed in each of the smaller hoops, each of the trackways having a pair of walls, at least one ball in each of the trackways, whereby the large hoop may be grasped and oscillated in a substantially vertical plane so that the balls in the respective smaller hoops rotate around the respective trackways by reason of centrifugal force, and at least one of the walls of one of the smaller hoops having a plurality of circumferentially-shaped apertures formed therein and communicating with the respective trackway in the one hoop, whereby an audible sound is produced as the respective ball rotates therein.

* * * * *